US011098983B1

(12) United States Patent
Sattayatam

(10) Patent No.: US 11,098,983 B1
(45) Date of Patent: Aug. 24, 2021

(54) AIRCRAFT PANEL INCLUDING BALLISTIC STAB-IN ARMOR

(71) Applicant: SAFRAN CABIN INC., Huntington Beach, CA (US)

(72) Inventor: Panade Sattayatam, Huntington Beach, CA (US)

(73) Assignee: SAFRAN CABIN INC., Huntington Beach, CA (US)

( * ) Notice: Subject to any disclaimer, the term of this patent is extended or adjusted under 35 U.S.C. 154(b) by 0 days.

(21) Appl. No.: 16/326,898

(22) PCT Filed: Jan. 29, 2019

(86) PCT No.: PCT/US2019/015721
§ 371 (c)(1),
(2) Date: Feb. 20, 2019

(87) PCT Pub. No.: WO2020/101727
PCT Pub. Date: May 22, 2020

Related U.S. Application Data

(60) Provisional application No. 62/760,156, filed on Nov. 13, 2018.

(51) Int. Cl.
*F41H 5/04* (2006.01)

(52) U.S. Cl.
CPC ..... *F41H 5/0407* (2013.01); *F41H 5/0471* (2013.01)

(58) Field of Classification Search
CPC ..... F41H 5/0407; F41H 5/0471
USPC ..... 89/36.02
See application file for complete search history.

(56) References Cited

U.S. PATENT DOCUMENTS 4,321,777 A * 3/1982 Sauret ..... B32B 17/10321 52/308
4,364,300 A * 12/1982 Pagano ..... B32B 15/04 89/36.02
4,960,631 A * 10/1990 Walters ..... B32B 17/10302 296/84.1

(Continued)

FOREIGN PATENT DOCUMENTS

DE 2324724 A1 11/1974
EP 1679484 A1 7/2006
WO 2010150197 A1 12/2010

OTHER PUBLICATIONS

Extended European Search Report dated Dec. 19, 2019 in EP19733648.0.

(Continued)

*Primary Examiner* — Samir Abdosh
(74) *Attorney, Agent, or Firm* — Jeffer Mangels Butler & Mitchell LLP; Brennan C. Swain, Esq.

(57) ABSTRACT

A panel assembly that includes inside and outside core layers, an armor layer sandwiched between the inside and outside core layers, and an armor member that includes at least an outside portion and a transverse portion. The outside core layer includes a cut out portion defined therein. The armor layer has opposing first and second major surfaces. The outside portion of the armor member is positioned in the cut out portion of the outside core layer and the outer surface of the transverse portion is generally perpendicular to the first and second major surfaces of the armor layer.

14 Claims, 5 Drawing Sheets

(56) References Cited

U.S. PATENT DOCUMENTS

| | | | | |
|---|---|---|---|---|
| 5,463,929 | A * | 11/1995 | Mejia | F41H 5/0457 109/49.5 |
| 5,637,363 | A * | 6/1997 | Leray | B32B 17/1077 428/34 |
| 5,670,734 | A * | 9/1997 | Middione | F41H 5/013 296/187.07 |
| 2002/0195030 | A1* | 12/2002 | Christiansen | E06B 9/00 109/49.5 |
| 2005/0172792 | A1* | 8/2005 | Wolf | F41H 5/0435 89/36.02 |
| 2015/0172792 | A1 | 6/2015 | Loos | |
| 2017/0153089 | A1* | 6/2017 | Bahu | B32B 27/065 |
| 2019/0383583 | A1* | 12/2019 | Carkner | B06B 1/064 |

OTHER PUBLICATIONS

Office Action dated Oct. 6, 2020 issued in related European application No. 19733648.0-1011.

International Search Report and Written Opinion issued in PCT/US19/15721.

* cited by examiner

AIRCRAFT PANEL INCLUDING BALLISTIC STAB-IN ARMOR

CROSS REFERENCE TO RELATED APPLICATIONS

This application is a national stage application, filed under 35 U.S.C. § 371, of International Patent Application No. PCT/US19/15721, filed on Jan. 29, 2019, which claims the benefit of U.S. Provisional Application No. 62/760,156, filed Nov. 13, 2018, the entireties of which are incorporated herein by reference.

FIELD OF THE INVENTION

The present invention relates generally to aircraft panels, and more particularly to an aircraft panel that includes ballistic stab-in armor.

BACKGROUND OF THE INVENTION

The need has arisen to develop an improved ballistic edge protection for aircraft panels such as those used in flight deck doors or other aircraft interior structures. Such structures include, but are not necessarily limited to, galleys, lavatories and closets and are collectively known as monuments. Current panel edge protection is heavy, expensive and requires ballistic resistant mechanical fasteners that result in holes in the panel and the armor. The current design adds weight, cost and introduces weaknesses at the fastener. Panel edge protection is critical because known panel armor defeats a ballistic threat easiest when the shot impacts the armored panel closer to its center, not at the edge. Panel armor such as ultra-high molecular weight polyethylene (UHMWPE) and para-aramid (e.g., Kevlar™) are multiple layer laminate armor systems which tend to pull material into the impact site. As the threat approaches the edge, there is less material to cradle the bullet sufficiently and the panel armor is compromised by either being destroyed or folding over from the bullet impact and allowing the ballistic threat to continue forward. Typically, the ballistic limitations of the edge of a panel are addressed by adding edge protection fortification. Such edge protection fortification is accomplished by adding a metal armor plate (steel or titanium for example) over the edge to mitigate the ballistic threat. This, however, increases the thickness of the panel armor and/or completely changes the laminate armor to a heavier metal solution thus increasing cost and weight. The current state of the art is further limited because aircraft interior flight deck doors and other monuments have strict design envelope requirements to limit interference with adjacent aircraft structure or other interior monuments or linings, therefore, increasing the thickness of the armor package may not be a feasible option.

SUMMARY OF THE PREFERRED EMBODIMENTS

In accordance with a first aspect of the present invention there is provided a panel assembly that includes inside and outside core layers, an armor layer sandwiched between the inside and outside core layers, and an armor member that includes at least an outside portion and a transverse portion. The outside core layer includes a cut out portion defined therein. The armor layer has opposing first and second major surfaces. The outside portion of the armor member is positioned in the cut out portion of the outside core layer and the outer surface of the transverse portion is generally perpendicular to the first and second major surfaces of the armor layer. In a preferred embodiment, the outside portion and transverse portion of the armor member define a channel, and at least a portion of the armor layer is received in the channel. Preferably, at least a portion of the inside and outside core layers are received in the channel.

In a preferred embodiment, the outside layer has a height, and the armor member extends the height of the outside layer. Preferably, the outside core layer includes an inner surface and an outer surface and the outer surface of the armor member is flush with the outer surface of the outside core layer. In a preferred embodiment, an outside skin is secured to the outer surface of the outside core layer and the outer surface of the armor layer. In a preferred embodiment, the panel assembly includes a trim member that includes an outside portion, an inside portion and a transverse portion that define a trim channel therebetween. Preferably, an outer surface of the armor member is received in the trim channel.

In a preferred embodiment, the inside core layer includes a cut out portion defined therein and the armor member includes an inside portion that is positioned in the cut out portion of the inside core layer. Preferably, the inside core layer includes an inner surface and an outer surface, the outside core layer includes an inner surface and an outer surface, and an inside skin is secured to the outer surface of the inside core layer and an outside skin is secured to the outer surface of the outside core layer.

In preferred embodiment, the inside and outside core layers are comprised of honeycomb or aluminum, the inside and outside skins are comprised of composite or aluminum, and the armor layer and armor member are comprised of UHMWPE or para-aramid.

The present invention protects the edge of an armored panel from ballistic threats striking in close proximity of the panel edge. Preferably, the present invention reduces cost and weight when compared to the prior art, and removes the requirement for special ballistic resistant mechanical fasteners. This is accomplished by inserting, or stabbing-in, the ballistic armored material into the edge of the panel directly as opposed to encompassing the outside of the panel. The armored stab-in is bonded within the panel, therefore removing the need for mechanical fasteners. Further, by bonding the stab-in armor internally the space requirements of the panel are preferably not increased. Steel or titanium metal armor, added as doublers, is not necessary. However, doublers can still be used if desired.

In a preferred embodiment, the stab-in armor is made from multiple layers of UHMWPE formed in a U, J or L shape made from being pressed in a heated tool. The honeycomb armor panel comprises composite or aluminum skins with a honeycomb composite or aluminum core. The lightweight UHMWPE or para-aramid armor is located in the center of the panel and adhered by adhesive to the core. The exposed core at the edge of the panel is routed out to accept the stab-in armor which lays flush beneath the panel face sheets. Structural adhesive is injected into the cavity before the stab-in armor is positioned permanently. The edge is then covered with edge trim to hide the stab-in armor from view. The curved geometry of the stab-in cradles the bullet at impact and creates a backstop effect that prevents the bullet from exiting as it is captured in stab-in armor insert. Such an in-situ edge armor stab-in provides an unseen, lightweight solution to ballistic edge protection that reduces the weight of the overall armor package compared to the prior art. The edge armor can be made in long sections and cut to required lengths thus minimizing production costs. It also provides a subtle ballistic solution to accommodate industrial design needs for a less obtrusive presence. It further removes the need for mechanical fasteners.

In three preferred embodiments, the stab-in armor can take various shapes within the panel including, but not necessarily limited to U, J and L shapes. The present invention is applicable to, but not limited to, use in aircraft flight deck doors, galleys, lavatories, closets, class dividers, partitions and bulkheads or any combination of such monuments or panels for such structures.

The present invention can be used in scenarios other than an aircraft. For example the invention can be used in other modes of transportation including but not limited to trains, cars, buses and vertical take-off and landing autonomous aircraft.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION OF THE PREFERRED EMBODIMENTS

Figure 1:
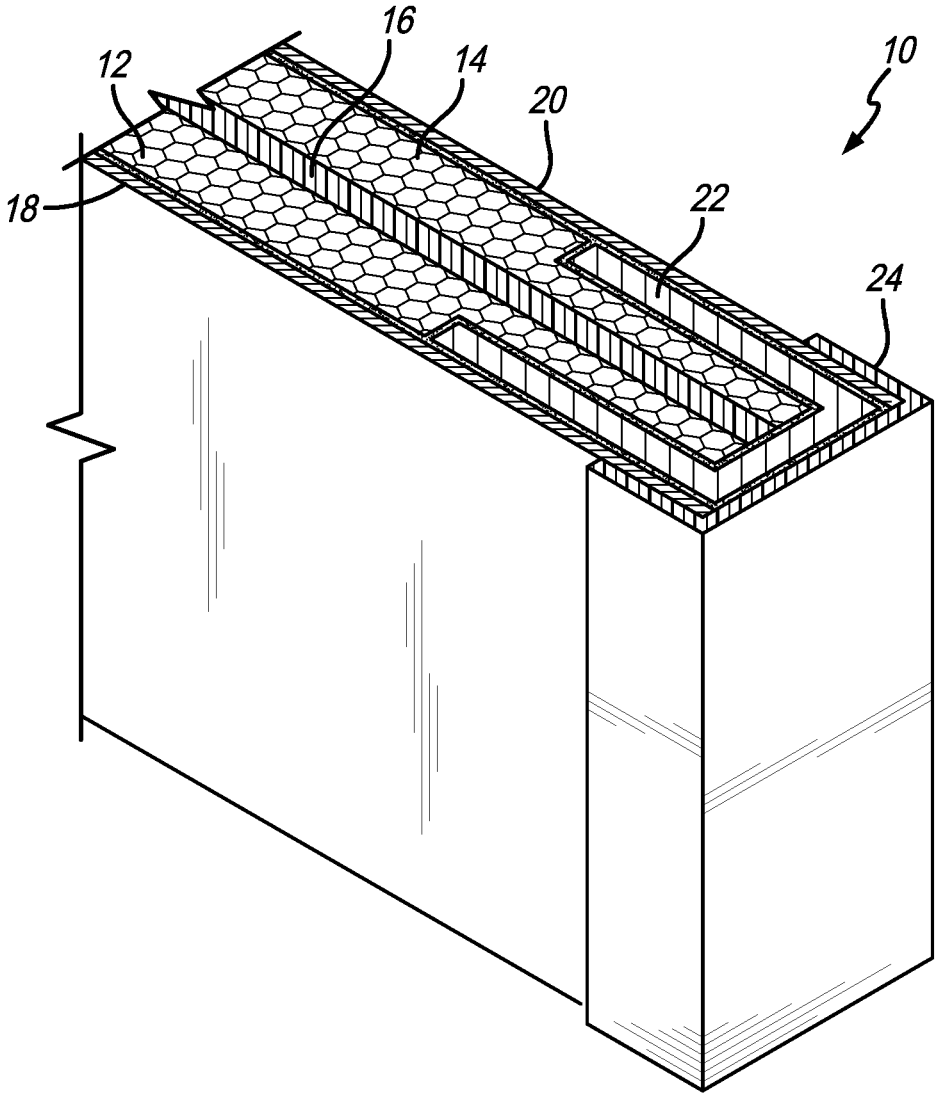
FIG. 1 is a cross-sectional perspective view of a panel assembly with a U-shaped armor member in accordance with a preferred embodiment of the present invention.

The following description and drawings are illustrative and are not to be construed as limiting. Numerous specific details are described to provide a thorough understanding of the disclosure. However, in certain instances, well-known or conventional details are not described in order to avoid obscuring the description. References to one or an embodiment in the present disclosure can be, but not necessarily are references to the same embodiment; and, such references mean at least one of the embodiments.

Reference in this specification to "one embodiment" or "an embodiment" means that a particular feature, structure, or characteristic described in connection with the embodiment is included in at least one embodiment of the-disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks: The use of highlighting has no influence on the scope and meaning of a term; the scope and meaning of a term is the same, in the same context, whether or not it is highlighted.

It will be appreciated that the same thing can be said in more than one way. Consequently, alternative language and synonyms may be used for any one or more of the terms discussed herein. No special significance is to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

It will be appreciated that terms such as "front," "back," "top," "bottom," "side," "short," "long," "up," "down," "aft," "forward," "inboard," "outboard" and "below" used herein are merely for ease of description and refer to the orientation of the components as shown in the figures. It should be understood that any orientation of the components described herein is within the scope of the present invention.

Figure 2:
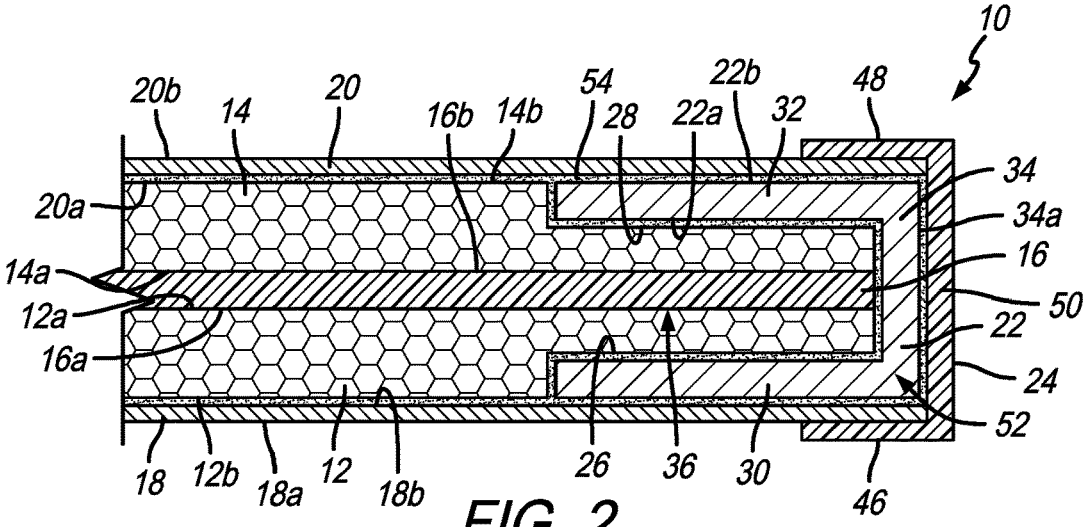
FIG. 2 is a cross-sectional view of a panel assembly with a U-shaped armor member.

Referring now to the drawings, wherein the showings are for purposes of illustrating the present invention and not for purposes of limiting the same, FIGS. 1-5 show a panel assembly 10 for use in situations where ballistics armor protection is desired. As shown in FIGS. 1 and 2, the panel assembly 10 generally includes inside and outside core layers 12 and 14, an armor layer 16, inside and outside skin layers 18 and 20, an armor member 22 and a trim member 24.

It will be appreciated that the terms "outside" and "inside" are used herein relative to the aircraft in which the panel assembly is positioned. For example, if the panel assembly is used as a flight deck door, the outside is the cabin and the inside is the cockpit. In this situation, the ballistic threat would come from a person trying to enter the cockpit (inside) from the cabin (outside). The terms "inner" and "outer" are used relative to the panel assembly itself, with the armor layer being the innermost and the inside and outside skin layers being the outermost (see, e.g., FIGS. 3-5). As shown in FIG. 2, the outside skin layer 20 has inner 20*a* and outer surfaces 20*b*, the inside core layer 12 has inner 12*a* and outer 12*b* surfaces, the outside core layer 14 has inner 14*a* and outer surfaces 14*b*, and the inside skin layer 18 has inner 18*a* and outer 18*b* surfaces and the armor layer has first and second major surfaces (which are each outer surfaces relative to the panel assembly 10.

Figure 3:
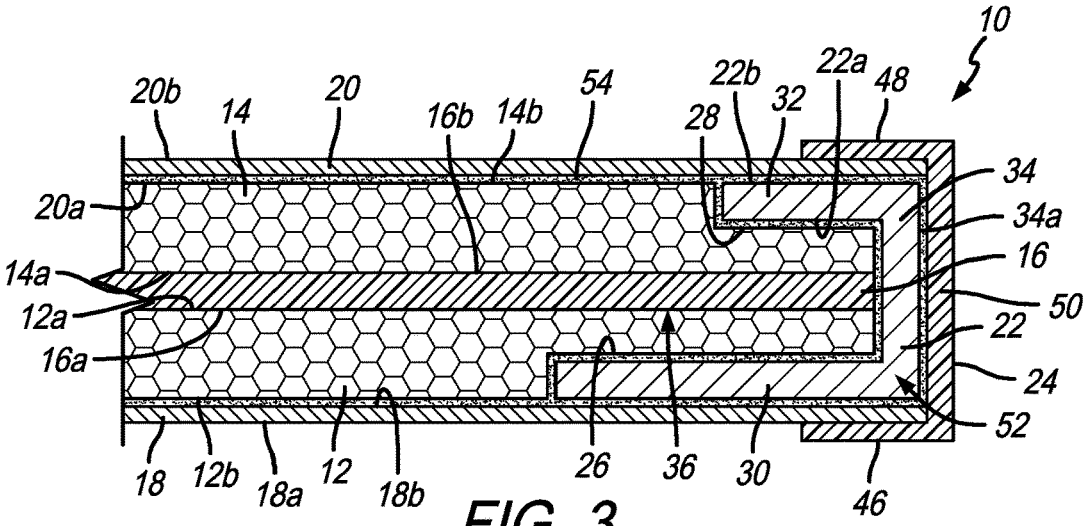
FIG. 3 is a cross-sectional view of a panel assembly with a J-shaped armor member.
Figure 4:
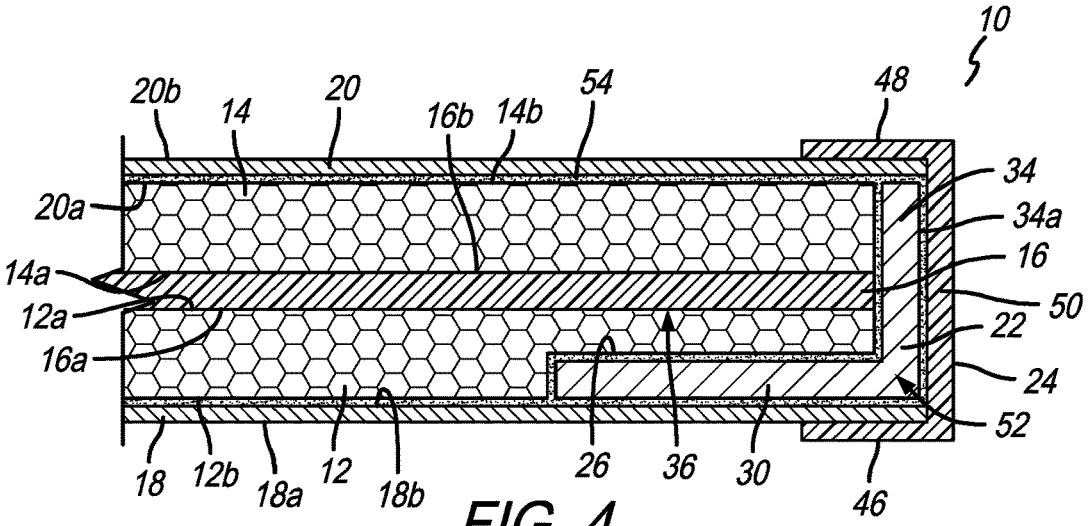
FIG. 4 is a cross-sectional view of a panel assembly with a L-shaped armor member.
Figure 5:
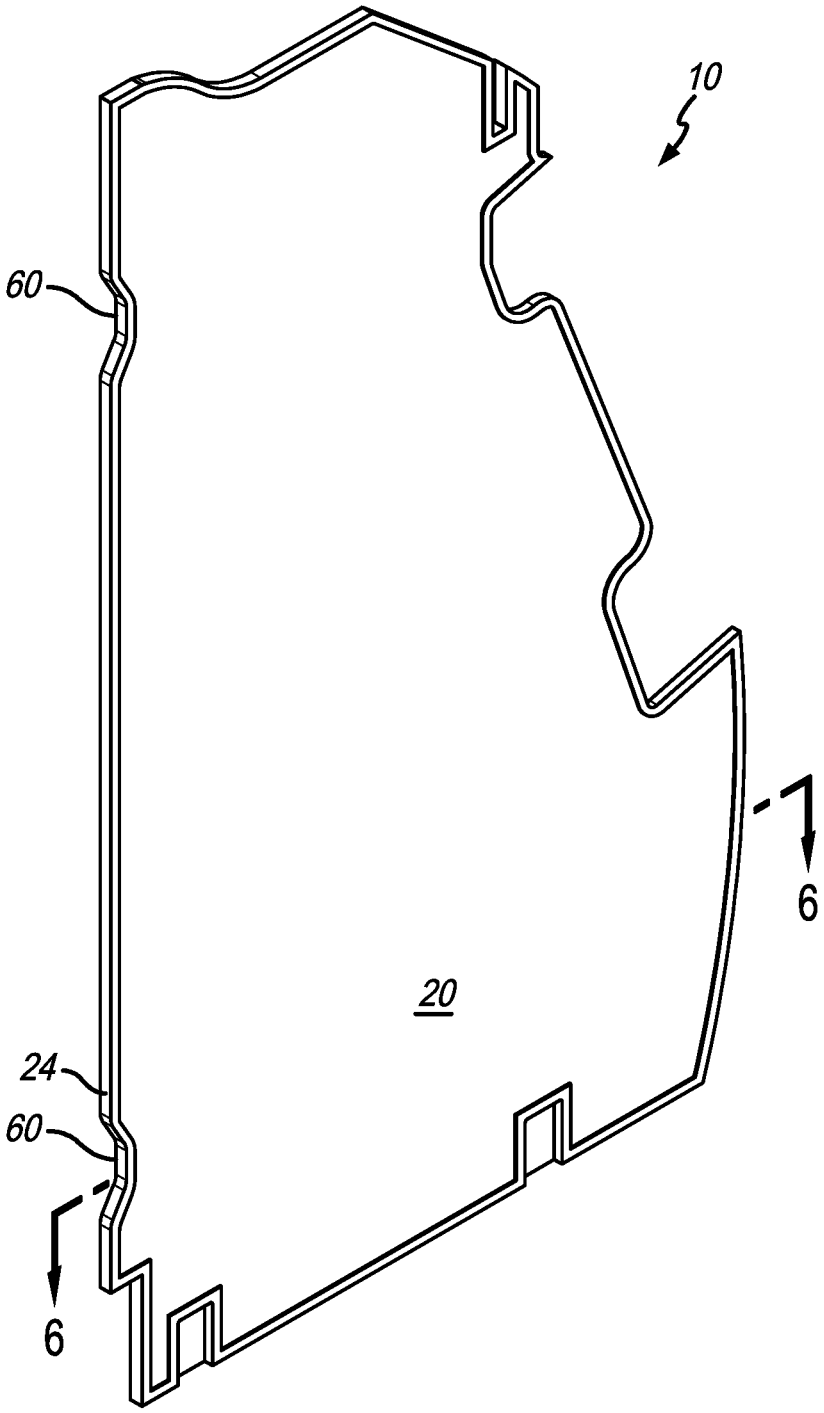
FIG. 5 is a perspective view of a bulkhead that includes the panel assembly of the present invention incorporated therein.
Figure 6:
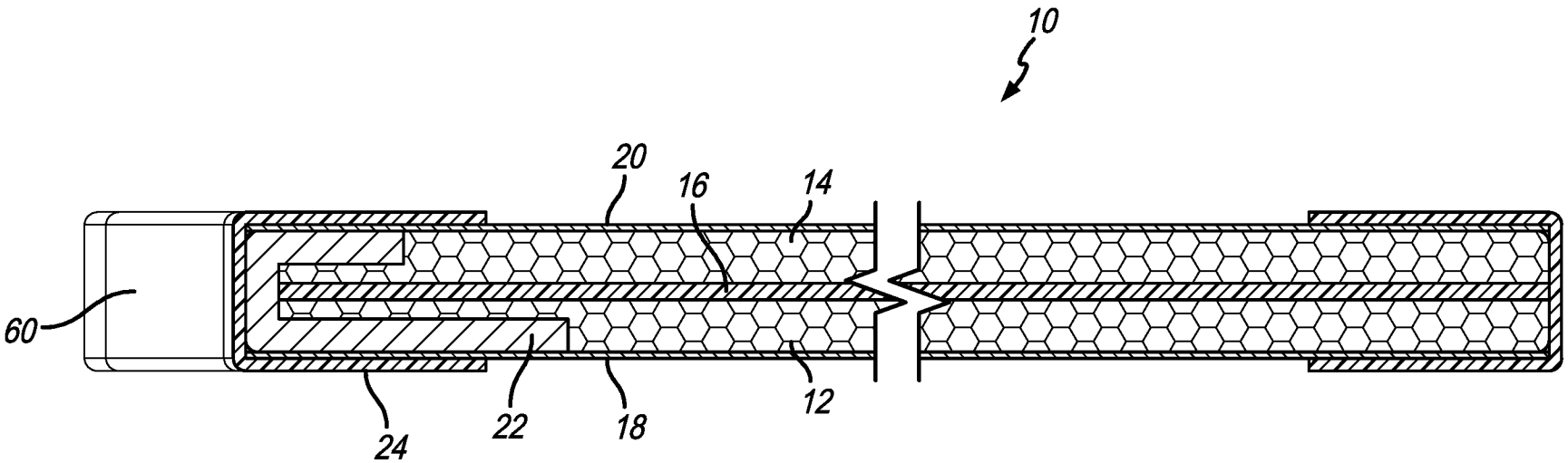
FIG. 6 is a cross-sectional view taken along line 5-5.

As shown in FIGS. 3-5, the armor layer 16 is sandwiched between the inside and outside core layers 12 and 14. The outside skin layer 20 is secured to the outer surface 14*b* of the outside core layer 14 and the inside skin layer 18 is secured to the outer surface 12*b* of the inside core layer 12. In a preferred embodiment, as shown in FIG. 2, the inside and outside core layers 12 and 14 include cut out portions 26 and 28, respectively, defined therein. In a preferred embodiment, the armor member 22 includes an inside portion 30, an outside portion 32 and a transverse portion 34 extending between the inside and outside portions 30 and 32. The inside portion 30, outside portion 32 and transverse 34 portion define a channel 36 therebetween. In an embodiment where the armor member 22 has an L-shape (FIG. 5), the outside portion 32 and transverse portion 34 define the channel 36. The armor member 22 includes an inner surface 22*a* and an outer surface 22*b*. As shown in FIGS. 3-5, the outside portion 32 of the armor member 22 is positioned in the cut out portion 28 of the outside core layer 14 and the inside portion 30 of the armor member 22 is positioned in the cut out portion 26 of the inside core layer 12. In a preferred embodiment, the outer surface 34*a* of the transverse portion 34 is generally perpendicular to the first and second major surfaces 16*a* and 16*b* of the armor layer 16 and at least a portion of the armor layer 16, outside core layer 14 and inside core layer 12 are received in the channel 36. In another embodiment, the channel 36 is narrow enough that only the armor layer 16 is received therein. In another embodiment, only one or more of the inside and/or outside core layers 12 and 14 are received in the channel 36.

In a preferred embodiment, the armor member 22 extends the full height of the panel assembly 10. In another embodiment, the armor member 22 does not extend the full height of the panel assembly 10. As shown in FIGS. 3-5, in a preferred embodiment, the outer surface 22*b* of the armor member 22 is flush with the outer surface of the outermost layer associated therewith, whether it be the outside skin layer 20, outside core layer 14, inside skin layer 18 or inside core layer 12.

As shown in FIG. 2, in a preferred embodiment, the trim member 24 includes an inside portion 46, an outside portion 48 and a transverse portion 50 that define a trim channel 52 therebetween. The trim member 24 is positioned to hide the armor member 22. The layers and components of the panel assembly 10 can be made of a number of different materials and those of ordinary skill in the aerospace or aviation industry will appreciate the different types of materials that can be used. For example, the inside and outside core layers can be comprised of honeycomb, aluminum or other material, the inside and outside skins can be comprised of composite, aluminum or other material, and the armor layer and armor member can be comprised of UHMWPE, para-aramid or other ballistic or bullet proof or resistant material.

Preferred methods for making the panel assembly 10 will now be described. Preferably, the armor member 22 is made from multiple layers of, e.g., UHMWPE formed in a U, J or L shape that is made from being pressed in a heated tool. The inside and outside skin layers 18 and 20 are adhered to the outer surfaces of the inside and outside core layers 12 and 14 and the armor layer 16 is positioned between the inside and outside core layers 12 and 14 and adhered by adhesive 54 thereto. Portions of the inside and outside core layers 12 and 14 are routed out or otherwise cut, trimmed, etc. to create the cut out portions 26 and 28. The armor member 22 is then fitted into the cut out portions 26 and 28 such that the armor layer 16, outside core layer 14 and inside core layer 12 are received in the channel 36 and so the outer surface 22*a* of the armor member 22 lays flush with the outer surfaces 12*b* and 14*b* of the inside and outside core layers 12 and 14. In a preferred embodiment, structural adhesive 52 is injected into the cut out portions 26 and 28 before the armor member 22 is positioned therein. The outer edge of the armor member 22 is then covered with the trim member 24 to hide the armor member 22 from view.

Figure 7:
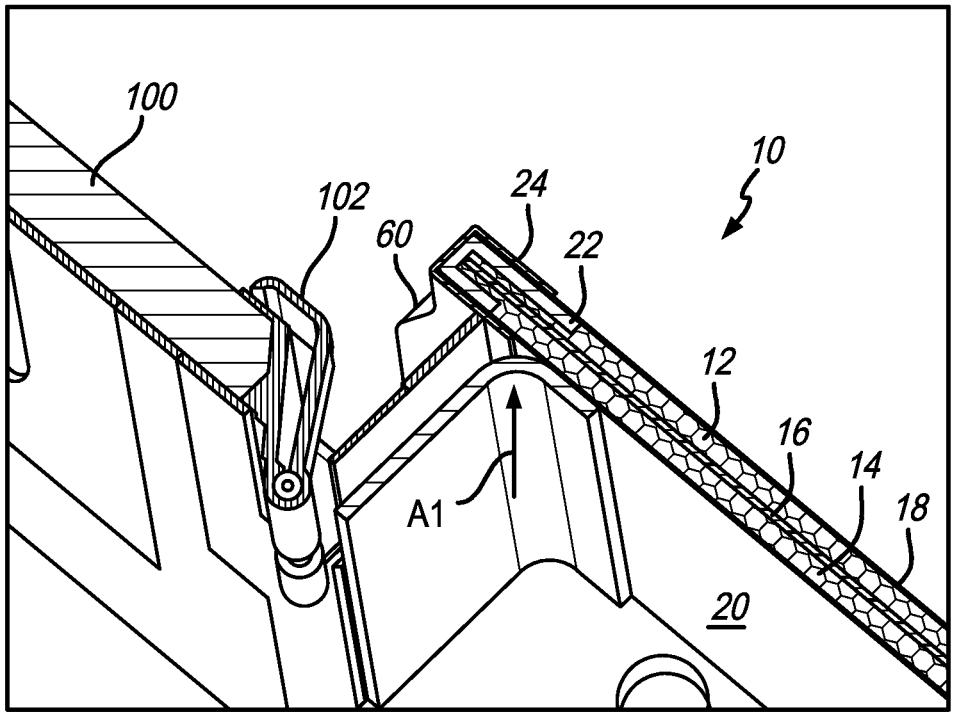
FIG. 7 is a cross-sectional view of the panel assembly installed with a door in an aircraft.

FIGS. 5 and 7 show a panel assembly 10 that can be used in conjunction with a flight deck door 100. The panel assembly 10 includes two scalloped or notched sections 60 that include armor members 22. These sections 60 provide access to manual door handles 102 to a pilot or other worker in the cockpit. The handles 102 are typically used for opening the door in an emergency. These sections 60 advantageously include the armor members 22 to prevent someone from firing bullets or other projectiles into that area to try and get the door 100 open. Arrow A1 shows an exemplary direction from a bullet may typically be fired. If the bullet gets passed the other components, due to the J-shaped armor member 22, the bullet will contact the armor member 22 and be directed inwardly and stopped, as shown by arrows A2.

It will be appreciated by those of ordinary skill in the art that the various features outlined to achieve the aircraft panel ballistic stab-in armor can be implemented individually or in combination without limitation.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description of the Preferred Embodiments using the singular or plural number may also include the plural or singular number respectively. The word "or" in reference to a list of two or more items, covers all of the following interpretations of the word: any of the items in the list, all of the items in the list, and any combination of the items in the list.

The above-detailed description of embodiments of the disclosure is not intended to be exhaustive or to limit the teachings to the precise form disclosed above. While specific embodiments of and examples for the disclosure are described above for illustrative purposes, various equivalent modifications are possible within the scope of the disclosure, as those skilled in the relevant art will recognize. Further, any specific numbers noted herein are only examples: alternative implementations may employ differing values, measurements or ranges.

The teachings of the disclosure provided herein can be applied to other systems, not necessarily the system described above. The elements and acts of the various embodiments described above can be combined to provide further embodiments. Any measurements described or used herein are merely exemplary and not a limitation on the present invention. Other measurements can be used. Further, any specific materials noted herein are only examples: alternative implementations may employ differing materials.

Any patents and applications and other references noted above, including any that may be listed in accompanying filing papers, are incorporated herein by reference in their entirety. Aspects of the disclosure can be modified, if necessary, to employ the systems, functions, and concepts of the various references described above to provide yet further embodiments of the disclosure.

These and other changes can be made to the disclosure in light of the above Detailed Description of the Preferred Embodiments. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features or aspects of the disclosure with which that terminology is associated. In general, the terms used in the following claims should not be construed to limit the disclosures to the specific embodiments disclosed in the specification unless the above Detailed Description of the Preferred Embodiments section explicitly defines such terms. Accordingly, the actual scope of the disclosure encompasses not only the disclosed embodiments, but also all equivalent ways of practicing or implementing the disclosure under the claims.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A panel assembly comprising:

inside and outside core layers, wherein the outside core layer includes a cut out portion defined therein, an armor layer sandwiched between the inside and outside core layers, wherein the armor layer has opposing first and second major surfaces, and an armor member that includes an outside portion and a transverse portion, wherein the outside portion of the armor member is positioned in the cut out portion of the outside core layer, and wherein an outer surface of the transverse portion is generally perpendicular to the first and second major surfaces of the armor layer.

2. The panel assembly of claim 1 wherein the outside portion and transverse portion of the armor member define a channel, and wherein at least a portion of the armor layer is received in the channel.

3. The panel assembly of claim 2 wherein at least a portion of the inside and outside core layers are received in the channel.

4. The panel assembly of claim 1 wherein the outside layer has a height, and wherein the armor member extends the height of the outside layer.

5. The panel assembly of claim 1 wherein the outside core layer includes an inner surface and an outer surface, wherein the outer surface of the armor member is flush with the outer surface of the outside core layer.

6. The panel assembly of claim 5 wherein an outside skin is secured to the outer surface of the outside core layer and the outer surface of the armor layer.

7. The panel assembly of claim 6 further comprising a trim member that includes an outside portion, an inside portion and a transverse portion that define a trim channel therebetween, wherein an outer surface of the armor member is received in the trim channel.

8. The panel assembly of claim 1 wherein the inside core layer includes a cut out portion defined therein, wherein the armor member includes an inside portion that is positioned in the cut out portion of the inside core layer.

9. The panel assembly of claim 8 wherein the inside core layer includes an inner surface and an outer surface, wherein the outside core layer includes an inner surface and an outer surface, wherein an inside skin is secured to the outer surface of the inside core layer and an outside skin is secured to the outer surface of the outside core layer.

10. The panel assembly of claim 1 wherein the inside and outside core layers are comprised of honeycomb or aluminum.

11. The panel assembly of claim 10 wherein the inside and outside skins are comprised of composite or aluminum.

12. The panel assembly of claim 10 wherein the armor layer and armor member are comprised of UHMWPE or para-aramid.

13. A panel assembly comprising:

inside and outside core layers, wherein the outside core layer includes a cut out portion defined therein, an armor layer sandwiched between the inside and outside core layers, wherein the armor layer has opposing first and second major surfaces, an armor member that includes an outside portion and a transverse portion, wherein the outside portion of the armor member is positioned in the cut out portion of the outside core layer, wherein an outer surface of the transverse portion is generally perpendicular to the first and second major surfaces of the armor layer, wherein the outside portion and transverse portion of the armor member define a channel, and wherein at least a portion of the armor layer is received in the channel, wherein at least a portion of the inside and outside core layers are received in the channel, wherein the outside core layer includes an inner surface and an outer surface, wherein the outer surface of the armor member is flush with the outer surface of the outside core layer, wherein an outside skin is secured to the outer surface of the outside core layer and the outer surface of the armor layer, wherein an inside skin is secured to the outer surface of the inside core layer, wherein the inside and outside core layers are comprised of honeycomb or aluminum, and wherein the armor layer and armor member are comprised of UHMWPE or para-aramid, and a trim member that includes an outside portion, an inside portion and a transverse portion that define a trim channel therebetween, wherein an outer surface of the armor member is received in the trim channel.

14. The panel assembly of claim 13 wherein the inside core layer includes a cut out portion defined therein, wherein the armor member includes an inside portion that is positioned in the cut out portion of the inside core layer, wherein the inside core layer includes an inner surface and an outer surface.

* * * * *